US006247236B1

(12) United States Patent
Johnson

(10) Patent No.: US 6,247,236 B1
(45) Date of Patent: Jun. 19, 2001

(54) BRAID HEAT SEALING DEVICE

(76) Inventor: Alice Johnson, 3300 Lyon Ave., Apt. 402, Houston, TX (US) 77027

( * ) Notice: Subject to any disclaimer, the term of this patent is extended or adjusted under 35 U.S.C. 154(b) by 0 days.

(21) Appl. No.: 09/575,305

(22) Filed: May 19, 2000

(51) Int. Cl.[7] ..... B26B 13/06
(52) U.S. Cl. ..... 30/140; 219/222
(58) Field of Search ..... 30/140; 132/118; 219/222, 223; 606/27

(56) References Cited

U.S. PATENT DOCUMENTS 3,980,861 * 9/1976 Fukunaya ..... 30/140 X
4,046,148 * 9/1977 Meador ..... 30/140 X
4,516,574 5/1985 Hewes, Jr. ..... 128/303
4,587,968 5/1986 Price ..... 128/303
5,046,251 9/1991 Scott ..... 30/140
5,309,640 5/1994 Caron ..... 30/140
5,472,654 * 12/1995 Crawford ..... 219/223 X
6,061,912 * 5/2000 Gazaway ..... 30/140

* cited by examiner

*Primary Examiner*—Douglas D. Watts
(74) *Attorney, Agent, or Firm*—Joseph N. Breaux

(57) ABSTRACT

A device including a scissor assembly for trimming synthetic braided hair extensions and a heating element for sealing the cut ends.

1 Claim, 2 Drawing Sheets

BRAID HEAT SEALING DEVICE

TECHNICAL FIELD

The present invention relates to hair styling tools and more particularly to a braid heat sealing device for cutting and heat sealing the cut end of synthetic braided hair extensions; the braid heat sealing device including a scissor assembly and a heating element assembly; the scissor assembly including two pivotally connected opposed scissor members each having a thermally insulated plastic handle portion connected to a metal scissor blade portion having a V-shaped notched formed therein that is alignable with the V-shaped notch of the other scissor member when the scissor assembly is in a closed position; the two scissor members being operable in a scissor cutting mode by squeezing the blade portions together; the heating element assembly including an electric resistance heater element bonded to one of the metal scissor blade portions and supplied with electrical power through wires molded into the plastic handle portion; the wires being connected to an electrical power source sufficient to cause electrical resistance heater element to become heated sufficiently to fuse a section of synthetic hair positioned within the two V-shaped notches.

BACKGROUND ART

Braided synthetic hair extensions are popular hair enhancement products. Although the extension provide desirable enhancements, they must often be trimmed to fit properly which, if not performed properly, can result in braids that become unraveled and unattractive. It would be a benefit, therefore, to have a device that could be used to trim synthetic braided hair extensions and seal the cut ends.

GENERAL SUMMARY DISCUSSION OF INVENTION

It is thus an object of the invention to provide a braid heat sealing device that includes a scissor assembly and a heating element assembly; the scissor assembly including two pivotally connected opposed scissor members each having a thermally insulated plastic handle portion connected to a metal scissor blade portion having a V-shaped notched formed therein that is alignable with the V-shaped notch of the other scissor member when the scissor assembly is in a closed position; the two scissor members being operable in a scissor cutting mode by squeezing the blade portions together; the heating element assembly including an electric resistance heater element bonded to one of the metal scissor blade portions and supplied with electrical power through wires molded into the plastic handle portion; the wires being connected to an electrical power source sufficient to cause electrical resistance heater element to become heated sufficiently to fuse a section of synthetic hair positioned within the two V-shaped notches.

Accordingly, a braid heat sealing device is provided. The braid heat sealing device includes a scissor assembly and a heating element assembly; the scissor assembly including two pivotally connected opposed scissor members each having a thermally insulated plastic handle portion connected to a metal scissor blade portion having a V-shaped notched formed therein that is alignable with the V-shaped notch of the other scissor member when the scissor assembly is in a closed position; the two scissor members being operable in a scissor cutting mode by squeezing the blade portions together; the heating element assembly including an electric resistance heater element bonded to one of the metal scissor blade portions and supplied with electrical power through wires molded into the plastic handle portion; the wires being connected to an electrical power source sufficient to cause electrical resistance heater element to become heated sufficiently to fuse a section of synthetic hair positioned within the two V-shaped notches.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
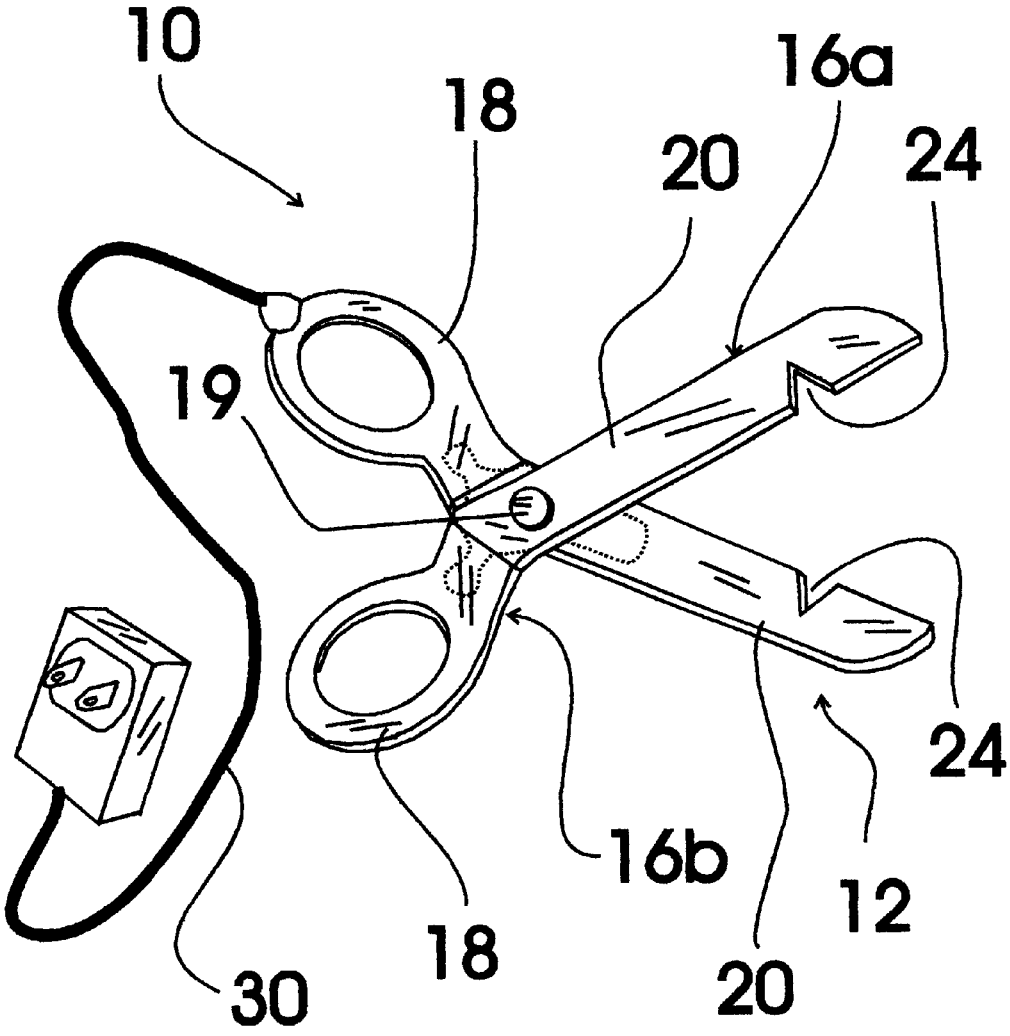
FIG. 1 is a perspective view of one side of an exemplary embodiment of the braid heat sealing device of the present invention.
Figure 2:
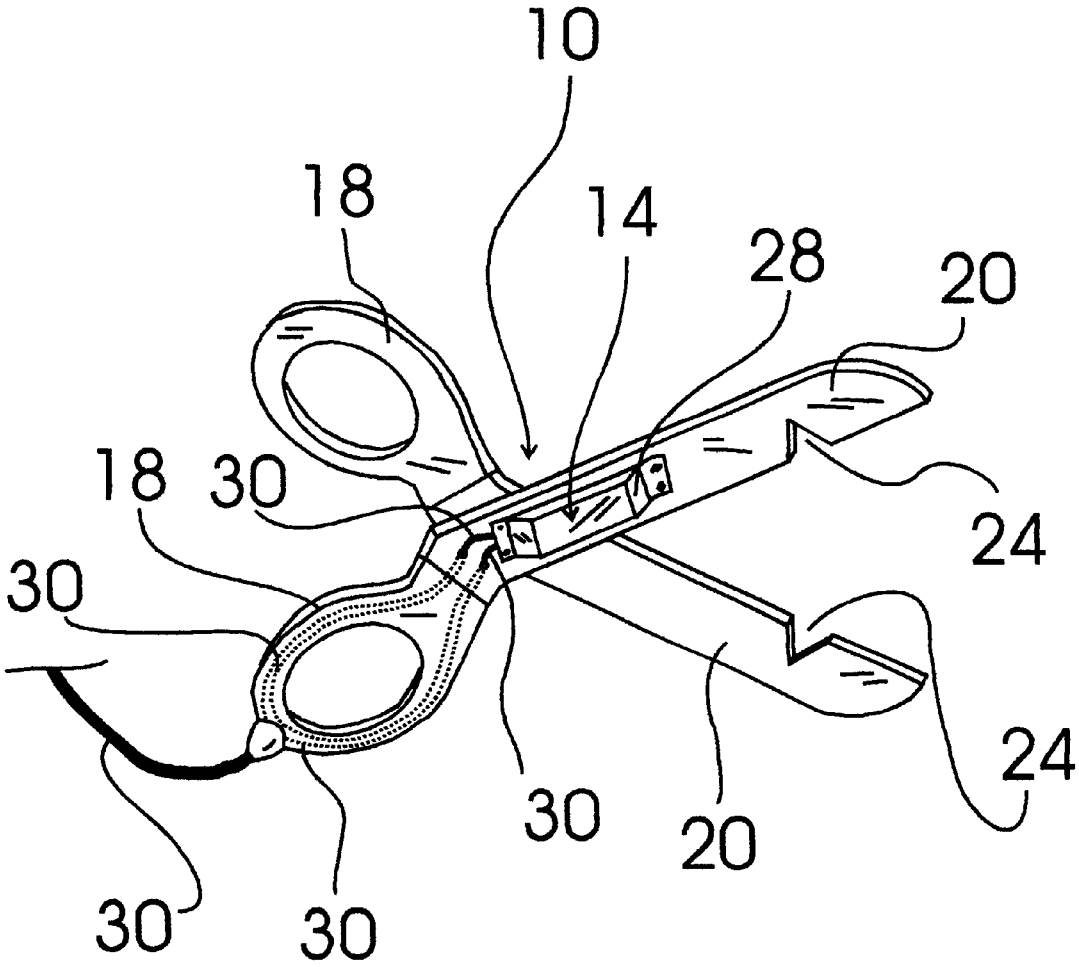
FIG. 2 is a perspective view of opposite side of the braid heat sealing device of FIG. 1.

FIGS. 1 and 2 show various aspects of an exemplary embodiment of the braid heat sealing device of the present invention generally designated 10. Braid heat sealing device 10 includes a scissor assembly, generally designated 12, and a heating element assembly, generally designated 14.

Scissor assembly 12 includes two pivotally connected opposed scissor members, generally designated 16*a*,16*b*, that are connected by a pivot pin 19. Each scissor member 16*a*,16*b* has a thermally insulated plastic handle portion 18 connected to a metal scissor blade portion 20 having a V-shaped notched 24 formed therein that is alignable with the V-shaped notch 24 of the other scissor blade portion 20 when the scissor assembly 12 is in a closed position. Scissor members 16*a*,16*b* operate in a scissor cutting mode by squeezing the blade portions 20 together.

Heating element assembly 14 includes an electric resistance heater element 28 that is bonded to one of the metal scissor blade portions 20 and supplied with electrical power through wires 30 molded into the plastic handle portion and extending out into connection with a conventional ac/dc plug in adapter. Although a plug in adapter is used as a power supply in this embodiment, it would be understood that a battery pack could also be used without departing from the spirit of the invention disclosed herein. Heating element 28 heats blade portions 20 to a temperature sufficient to heat fuse sections of synthetic hair positioned within the two V-shaped notches 24 to prevent unraveling and provide a secure braid termination that will last.

It can be seen from the preceding description that a braid heat sealing device has been provided.

It is noted that the embodiment of the braid heat sealing device described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A braid heat sealing device comprising:

a scissor assembly; and a heating element assembly;

said scissor assembly including two pivotally connected opposed scissor members each having a thermally insulated plastic handle portion connected to a metal scissor blade portion having a V-shaped notched formed therein that is alignable with said V-shaped notch of said other scissor member when said scissor assembly is in a closed position;

said two scissor members being operable in a scissor cutting mode by squeezing said blade portions together;

said heating element assembly including an electric resistance heater element bonded to one of said metal scissor blade portions and supplied with electrical power through wires molded into said plastic handle portion;

said wires being connected to an electrical power source sufficient to cause electrical resistance heater element to become heated sufficiently to fuse a section of synthetic hair positioned within said two V-shaped notches.

* * * * *